US009543687B2

(12) United States Patent
Horiuchi et al.

(10) Patent No.: US 9,543,687 B2
(45) Date of Patent: Jan. 10, 2017

(54) CONNECTOR

(71) Applicant: Sumitomo Wiring Systems, Ltd., Yokkaichi, Mie (JP)

(72) Inventors: Hidefumi Horiuchi, Mie (JP); Hideto Nakamura, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 14/955,113

(22) Filed: Dec. 1, 2015

(65) Prior Publication Data

US 2016/0181720 A1 Jun. 23, 2016

(30) Foreign Application Priority Data

Dec. 22, 2014 (JP) ..... 2014-258643

(51) Int. Cl.

| | |
|---|---|
| ***H01R 3/00*** | (2006.01) |
| ***H01R 13/502*** | (2006.01) |
| ***H01R 13/627*** | (2006.01) |
| ***H01R 13/639*** | (2006.01) |
| *H01R 103/00* | (2006.01) |
| *H01R 13/641* | (2006.01) |

(52) U.S. Cl.

CPC ..... *H01R 13/502* (2013.01); *H01R 13/6272* (2013.01); *H01R 13/639* (2013.01); *H01R 13/641* (2013.01); *H01R 2103/00* (2013.01)

(58) Field of Classification Search

USPC ..... 439/489

See application file for complete search history.

(56) References Cited

U.S. PATENT DOCUMENTS

| | | | | |
|---|---|---|---|---|
| 5,066,244 | A * | 11/1991 | Kato | H01R 13/641 439/489 |
| 7,591,668 | B2 * | 9/2009 | Nakamura | H01R 13/641 439/489 |
| 7,722,385 | B2 * | 5/2010 | Nakamura | H01R 13/641 439/489 |
| 7,980,880 | B2 * | 7/2011 | Kodama | H01R 13/6272 439/352 |
| 2009/0170362 | A1 | 7/2009 | Nakamura | |

FOREIGN PATENT DOCUMENTS

| | | |
|---|---|---|
| JP | 2009-158263 | 7/2009 |

* cited by examiner

*Primary Examiner* — Tho D Ta

(74) *Attorney, Agent, or Firm* — Gerald E. Hespos; Michael J. Porco; Matthew T. Hespos

(57) ABSTRACT

It is aimed to provide a connector capable of ensuring the integrity of a lock arm and a detector in the process of deflecting the lock arm and enhancing a degree of freedom in designing the lock arm. A detector (60) movable in a front-back direction between a standby position and a detection position is assembled with a housing (10). The detector (60) includes a contact portion (78) displaceable together with a front end part (27) of a lock arm (23) during the interference of the front end part (27) of the lock arm (23) and a mating lock (44) contacting the front part (27) of the lock arm (23) in a height direction intersecting with the front-back direction at the standby position. The contact portion (78) stands up in the height direction from a front end part of the locking arm and then projects forward.

5 Claims, 15 Drawing Sheets

CONNECTOR

BACKGROUND

1. Field of the Invention

The invention relates to a connector.

2. Description of the Related Art

Japanese Unexamined Patent Publication No. 2009-158263 discloses a connector with a first housing connectable to a second housing. A detector is assembled with the first housing and is movable between a standby position and a detection position located before the standby position. The detector has a deflection piece with a locking projection. The first housing has a lock arm with a lock hole, and the mating housing is provided with a lock projection.

A front part of the lock arm interferes with the lock projection in the process of connecting the two housings and this interference causes the lock arm to deflect. As a result, the locking projection enters the lock hole and contacts the front end of the lock hole, thereby keeping the detector in a state where a movement to the detection position is regulated.

The lock projection fits into the lock hole and pushes out the locking projection when the connection of the two housings is completed and the deflection piece is deflected and deformed as the lock arm returns. As a result, the detector can move to the detection position and the two housings are held in a state where separation of the two housings is regulated. Thus, an ability to move the detector from the standby position to the detection position indicates that the two housings are in a properly connected state.

In the above case, a front part of the deflection piece is in contact with the front part of the lock arm from above when the detector is at the standby position. Thus, the front part of the deflection piece can be displaced up together with the front part of the lock arm as the front part of the lock arm and the lock projection interfere with each other. Also, the integrity of the lock arm and the detector can be ensured in the process of deflecting the lock arm. However, the upper surface of an extending portion including the deflection piece is continuous at the same height over the entire length and the extending portion is relatively thick. Thus, opening dimensions of a guide space of the lock arm for receiving the extending portion tend to be large. As a result, there is little space to add a new structure to the lock arm, and there is a low degree of freedom in design.

The invention was completed based on the above situation and aims to provide a connector capable of ensuring the integrity of a lock arm and a detector in the process of deflecting the lock arm and enhancing a degree of freedom in design.

SUMMARY

The invention is directed to a connector with a housing and a mating housing that are connectable to one another. A lock arm extends in a front-back direction on the housing and has a lock hole. The mating housing includes a mating lock. A detector is assembled with the housing and is movable in the front-back direction between a standby position and a detection position. A locking arm extends in the front-back direction on the detector and has a locking portion. The mating lock interferes with the front part of lock arm in the process of connecting the two housings and the locking portion is inserted into the lock hole to lock the locking arm to the lock arm, thereby keeping the detector at the standby position in the process of connecting the housings. The mating lock is fit into the lock hole and pushes the locking portion out as the lock arm returns, thereby releasing the locking between the locking arm and the lock arm and permitting a movement of the detector to the detection position. Thus, the two housings are held in a state where separation of the housings is regulated when the connection of the two housings is completed. The detector includes a contact portion that stands up in the height direction from a front part of the locking arm and then projects forward. The contact portion is displaceable together with the front end part of the lock arm during the interference of the front end part of the lock arm and the mating lock caused by contact with the front end part of the lock arm in a height direction at the standby position.

The contact portion of the detector engages the front end part of the lock arm in the height direction at the standby position, and hence the contact portion displaces together with the tip part of the lock arm during the interference of the front end part of the lock arm and the mating lock. Thus, the integrity of the lock arm and the detector can be ensured in the process of deflecting the lock arm. Further, the contact portion stands up in the height direction from the front end part of the locking arm and then projects forward. Thus, a part of the lock arm is provided in an area of the detector behind the contact portion, thereby enhancing design freedom of the lock arm.

A movement regulating portion may be provided to regulate inadvertent movement of the detector from the detection position to the standby position. The movement regulating portion may be on a rear end part of the lock arm and may be configured to interfere with the detector at the detection position. The movement regulating portion and the contact portion may be arranged at positions overlapping each other in the height direction so that the movement regulating portion does not increase a height of the connector as a whole.

DETAILED DESCRIPTION

A connector in accordance with an embodiment of the invention includes a housing 10, a mating housing 40 that is connectable to the housing 10, and a detector 60 assembled with the housing 10 for movement between a standby position and a detection position. In the following description, ends of the housings 10, 40 that face each other at the start of connection are referred to as front ends concerning a front-back direction, a vertical direction is based on FIGS. 1, 7 to 11, 13 and 14 and a lateral direction is based on FIGS. 1, 11, 13 and 14. The vertical direction is synonymous with a height direction and the lateral direction is synonymous with a width direction.

Figure 7:
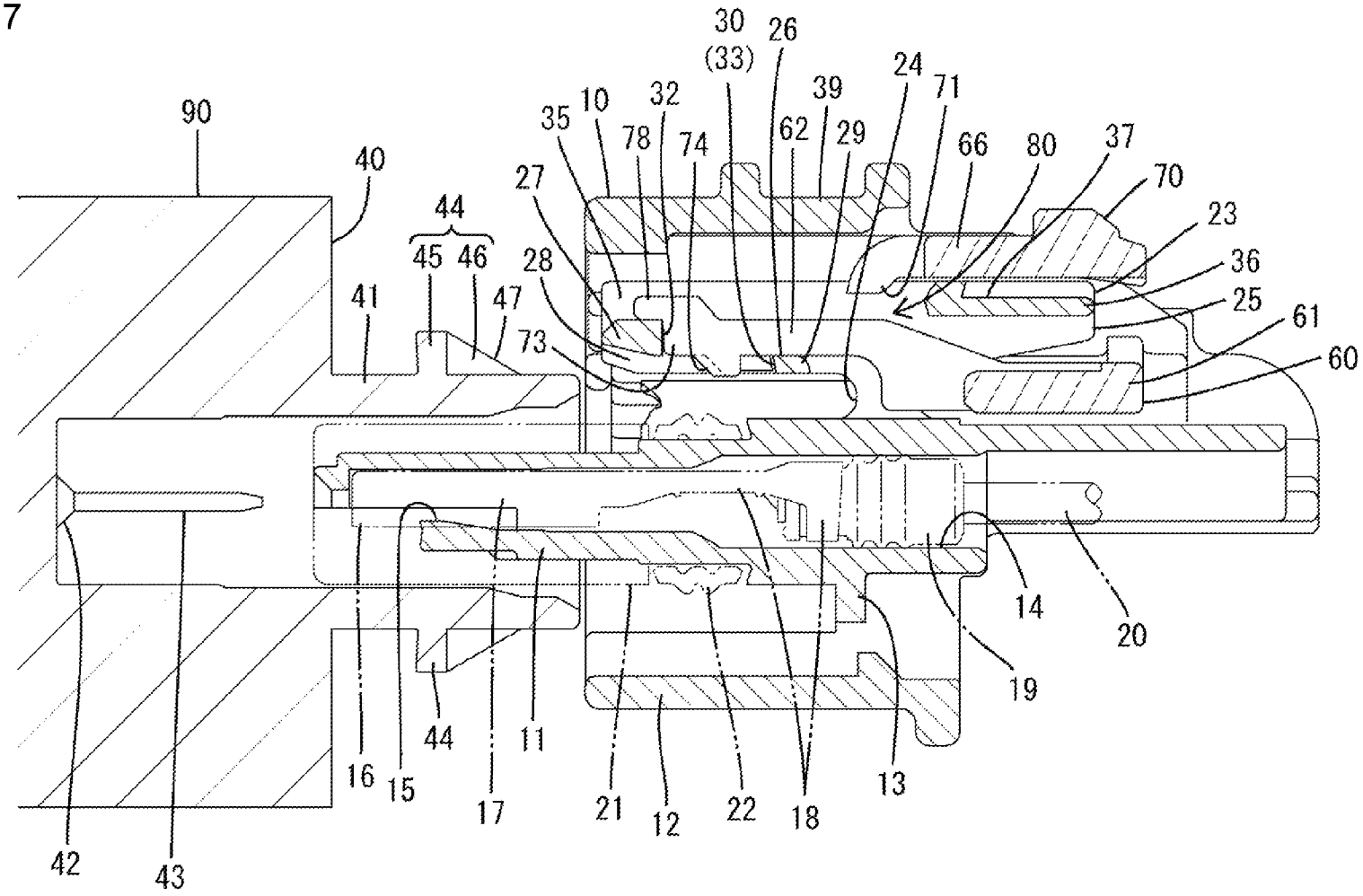
FIG. 7 is a side view in section showing the state while the mating housing is being connected to the housing.

The mating housing 40 is made of synthetic resin and, as shown in FIG. 7, includes a tubular receptacle 41 directly connected to a device 90 and projecting forward. Tabs 43 of mating terminal fittings 42 project into the receptacle 41. Two mating locks 44 project on outer surfaces of both upper and lower walls of the receptacle 41. The upper mating lock 44 is lockable to a lock arm 23 of the housing 10.

Figure 3:
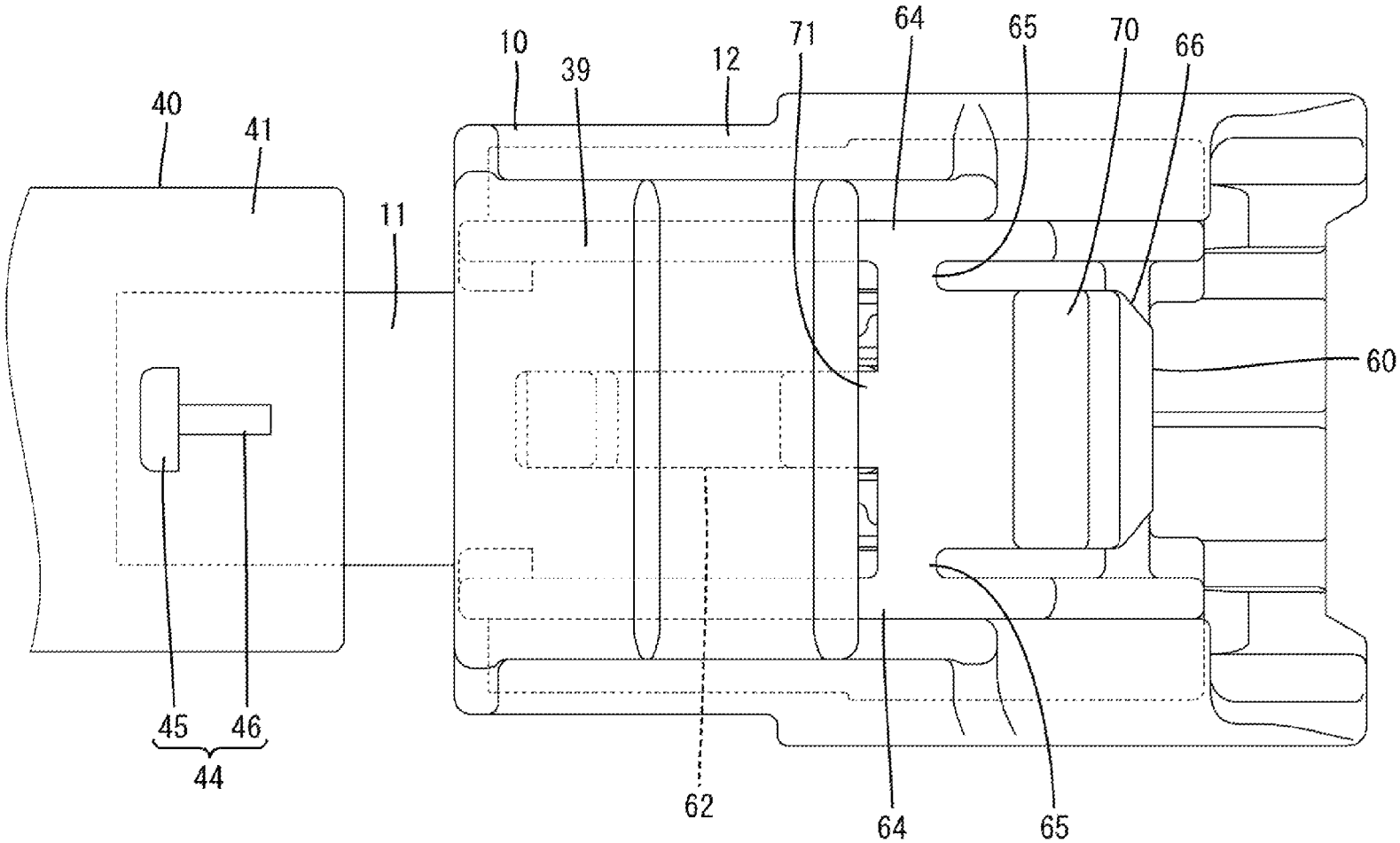
FIG. 3 is a plan view showing a mating housing being connected to the housing.

As shown in FIG. 3, the mating lock 44 includes a plate-shaped mating lock main body 45 extending along the lateral direction and a plate-shaped projecting piece 46 projecting forward from a lateral central part of the mating lock main body 45 to define a T-shape in a plan view. As shown in FIG. 7, the mating lock main body 45 extends substantially vertically, but with the rear surface of the mating lock main body 45 inclined somewhat backward toward the upper end. Further, the projecting piece 46 has a right-triangular shape in a side view with an inclined front edge 47 inclined up toward the back. The front end of the inclined edge 47 is connected to the outer surface of the upper wall of the receptacle 41 and the rear end of the inclined edge 47 is connected to the upper end of the mating lock main body 45.

The housing 10 is made of synthetic resin and includes, as shown in FIG. 7, a housing main body 11 long and narrow in the front-back direction, a fitting tube 12 surrounding the housing main body 11 and a radially extending coupling 13 connecting the fitting tube 12 and the housing main body 11. A front part of the housing main body 11 projects farther forward than the front end of the fitting tube 12. The receptacle 41 of the mating housing 40 can fit into a space between the housing main body 11 and the fitting tube 12 and forward of the coupling 13.

Figure 11:
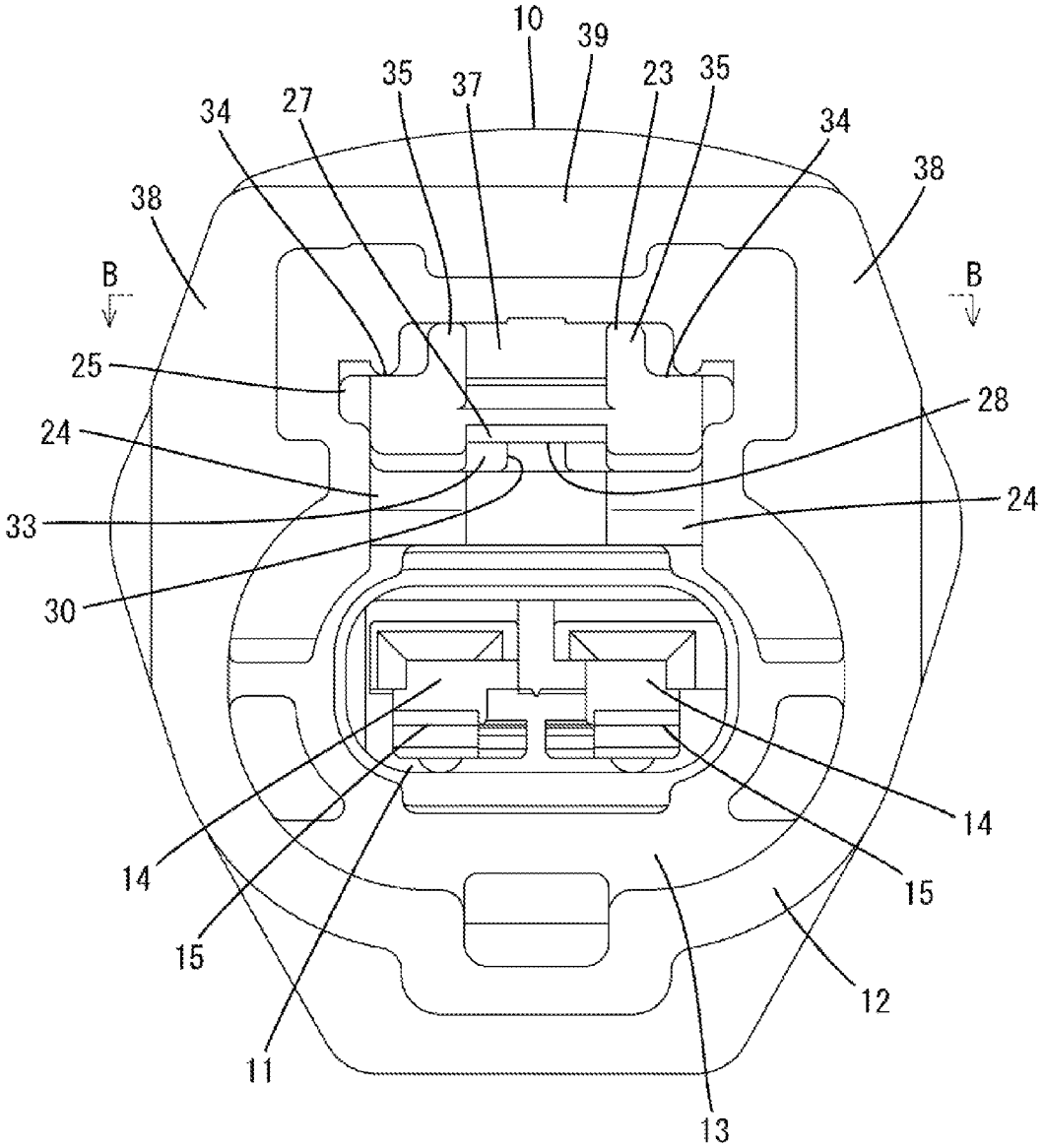
FIG. 11 is a front view of the housing.

As shown in FIG. 11, left and right cavities 14 are provided in the housing main body 11 and are arranged side by side. As shown in FIG. 7, a deflectable locking lance 15 projects forward from the fitting tube 12 at the lower surface of the inner wall of the cavity 14. A terminal fitting 16 is inserted into the cavity 14 of the housing main body 11 from behind.

The terminal fitting 16 is made of electrically conductive metal and, as shown in FIG. 7, is long and narrow in the front-back direction. The terminal fitting 16 includes a tubular terminal main body 17 on a front end and an open barrel 18 at a rear end. The tab 43 of the mating terminal fitting 42 is inserted into the terminal main body 17 for connection when the two housings 10, 40 are connected properly. The barrel 18 is crimped into connection with an end part of a wire 20 and a rubber plug 19. The locking lance 15 locks terminal main body 17 when the terminal fitting 16 is inserted properly into the cavity 14 so that the terminal fitting 16 is retained in the cavity 14. Further, the rubber plug 19 closely contacts the inner peripheral surface of a rear end part of the cavity 14 to seal the interior of the cavity 14 in a liquid-tight manner when the terminal fitting 16 is inserted properly, and the wire 20 is drawn out backward from the housing main body 11.

Figure 9:
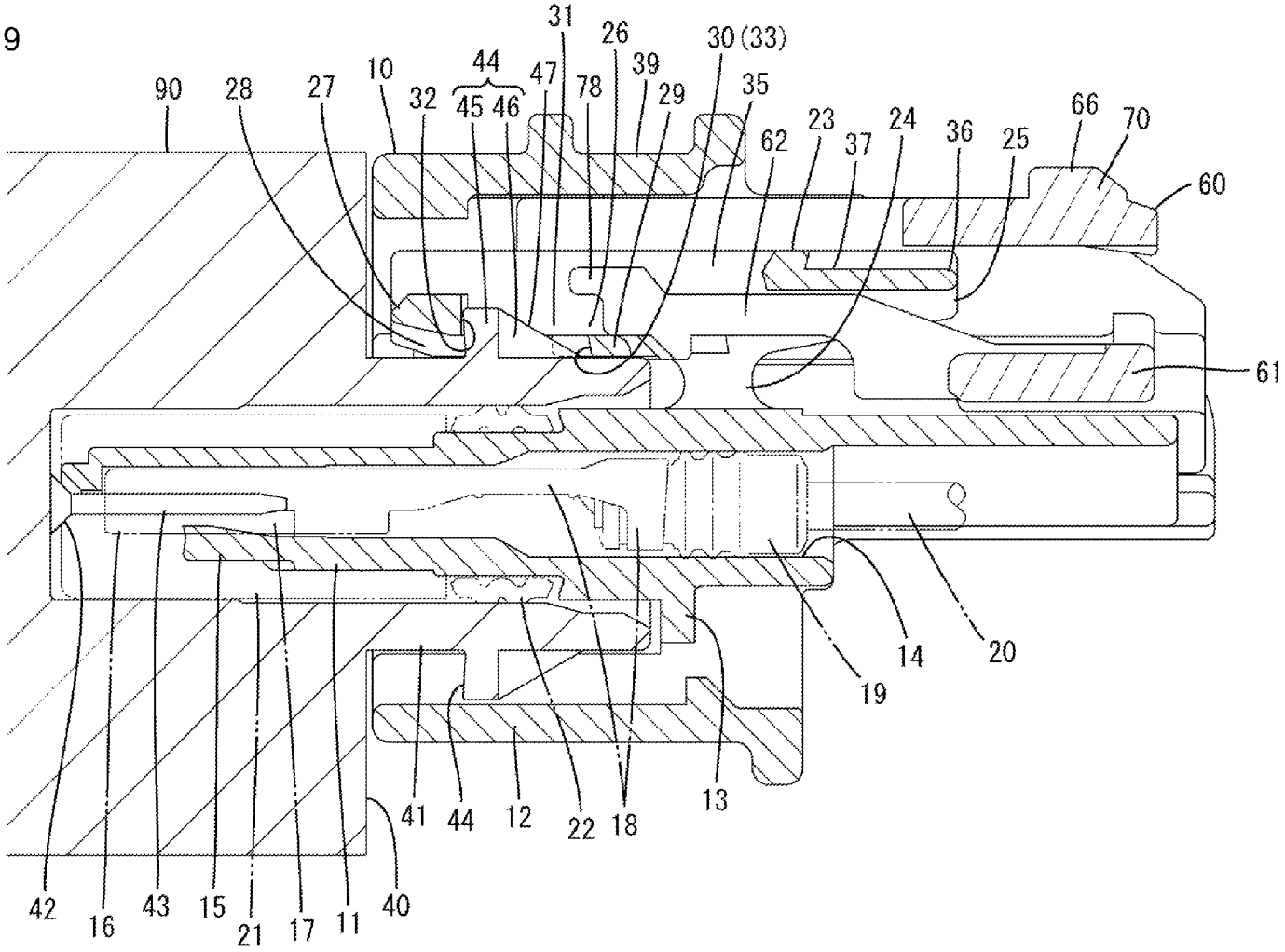
FIG. 9 is a side view in section showing the state where the mating housing is connected properly to the housing.

A front retainer 21 is mounted onto the housing main body 11 from the front, as shown in FIG. 7. The front retainer 21 enters deflection spaces for the locking lances 15 to regulate the deflection of the locking lances 15 and to achieve redundant retention of the terminal fittings 16 in the cavities 14. Further, a rubber seal ring 22 is fit on the outer peripheral surface of the housing main body 11. As shown in FIG. 9, the seal ring 22 is sandwiched resiliently in a radial direction between the receptacle 41 and the housing main body 11 when the housings 10, 40 are connected properly, thereby sealing between the two housings 10, 40 in a liquid-tight manner.

The lock arm 23 is provided above the housing main body 11. As shown in FIG. 7, the lock arm 23 includes a leg 24 standing up from the upper surface of the housing main body 11 and a lock arm main body 25 extending forward and backward from the upper end of the leg 24. The lock arm main body 25 is pivotally and resiliently displaceable in a seesaw manner with the leg 24 as a support. The rear end of the housing main body 11 is located behind the lock arm main body 25 and an area where the detector 60 is arranged is exposed upward on the upper surface of the rear part of the housing main body 11.

As shown in FIG. 9, a rearwardly open first groove 26 extends in the front-back direction on an upper part of the lock arm main body 25. The first groove 26 is open upward except at a rear end where the first groove 26 is covered by a movement regulating portion 36. The front end of the first groove 26 is partitioned by a front part 27 of the lock arm main body 25.

Figure 5:
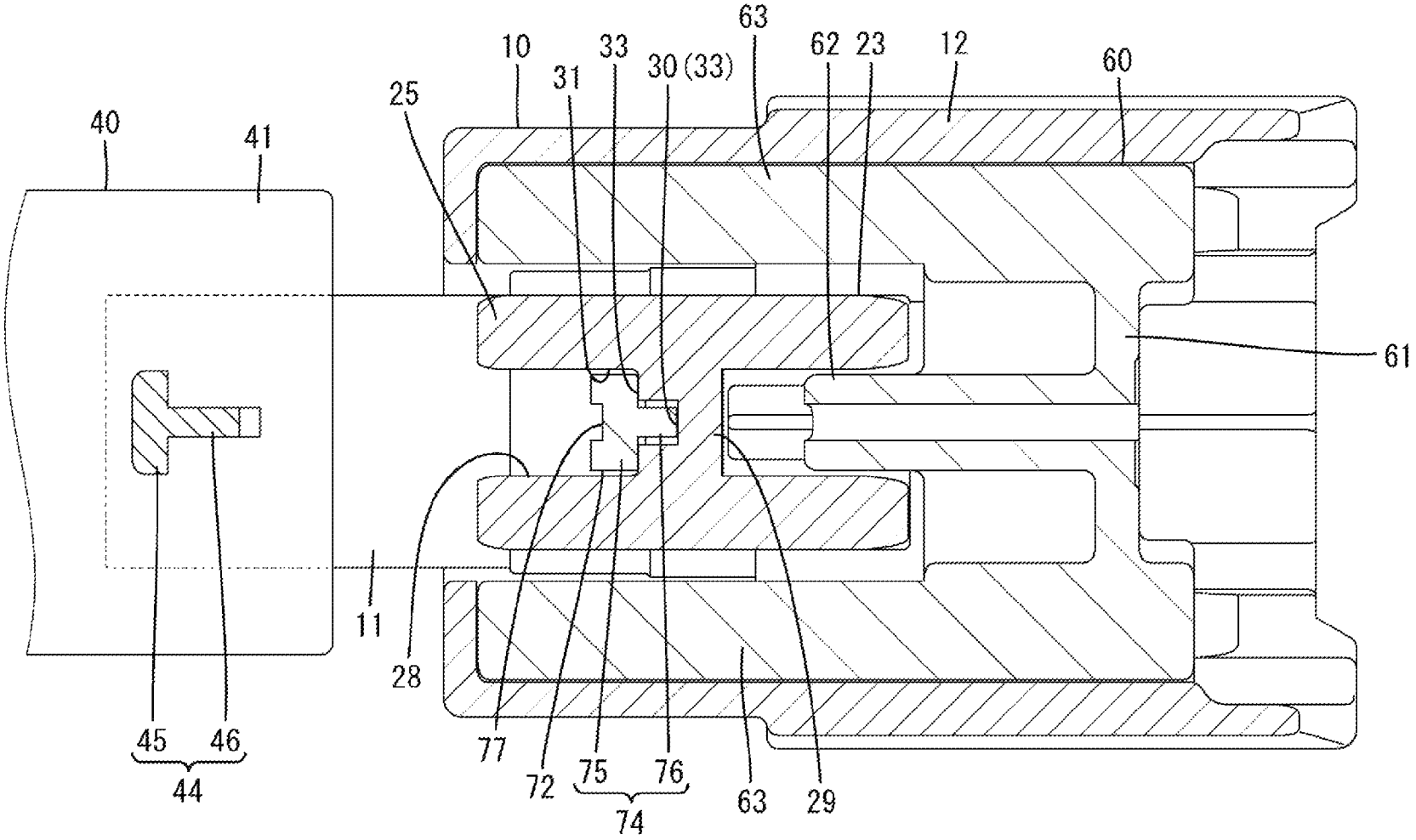
FIG. 5 is section corresponding to FIG. 3.
Figure 10:
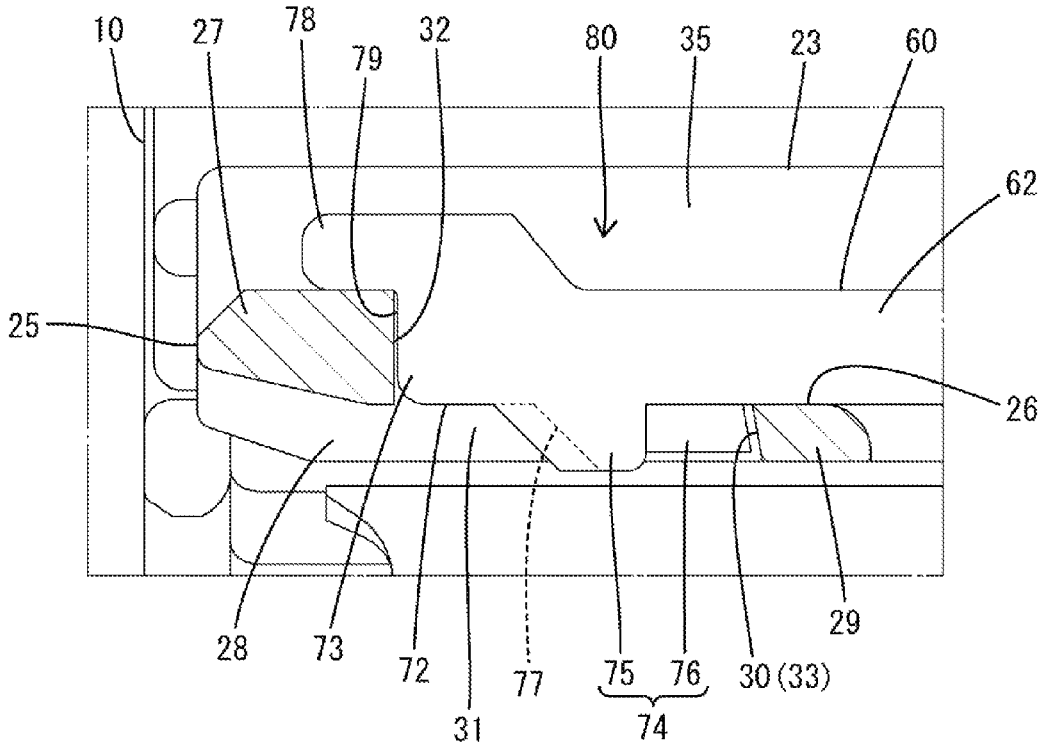
FIG. 10 is an enlarged view of an essential part of FIG. 9.

A forwardly open second groove 28 extends in the front-back direction on a lower part of the lock arm main body 25, as shown in FIGS. 9 and 10. The rear end of the second groove 28 is partitioned by a lower wall 29 of the lock arm main body 25. The lower wall 29 of the lock arm main body 25 is located before the leg 24 and defines the lower surface of a front end of the first groove 26. Further, as shown in FIG. 5, the lower wall 29 is cut to provide a recess 30 extending backward from the front surface of the lower wall 29. As shown in FIG. 10, the recess 30 also is open on the upper surface of the lower wall 29 to face the first groove 26. The back surface of the recess 30 is inclined back toward the lower end.

A lock hole 31 penetrates the lock arm main body 25 vertically at a position facing the front part 27, as shown in FIG. 10, so that the first and second grooves 26, 28 communicate with each other. As shown in FIG. 9, the mating lock 44 is fit into the lock hole 31 when the two housings 10, 40 are connected properly and holds the two housings 10, 40 in a state where separation of the two housings 10, 40 is regulated.

Figure 12:
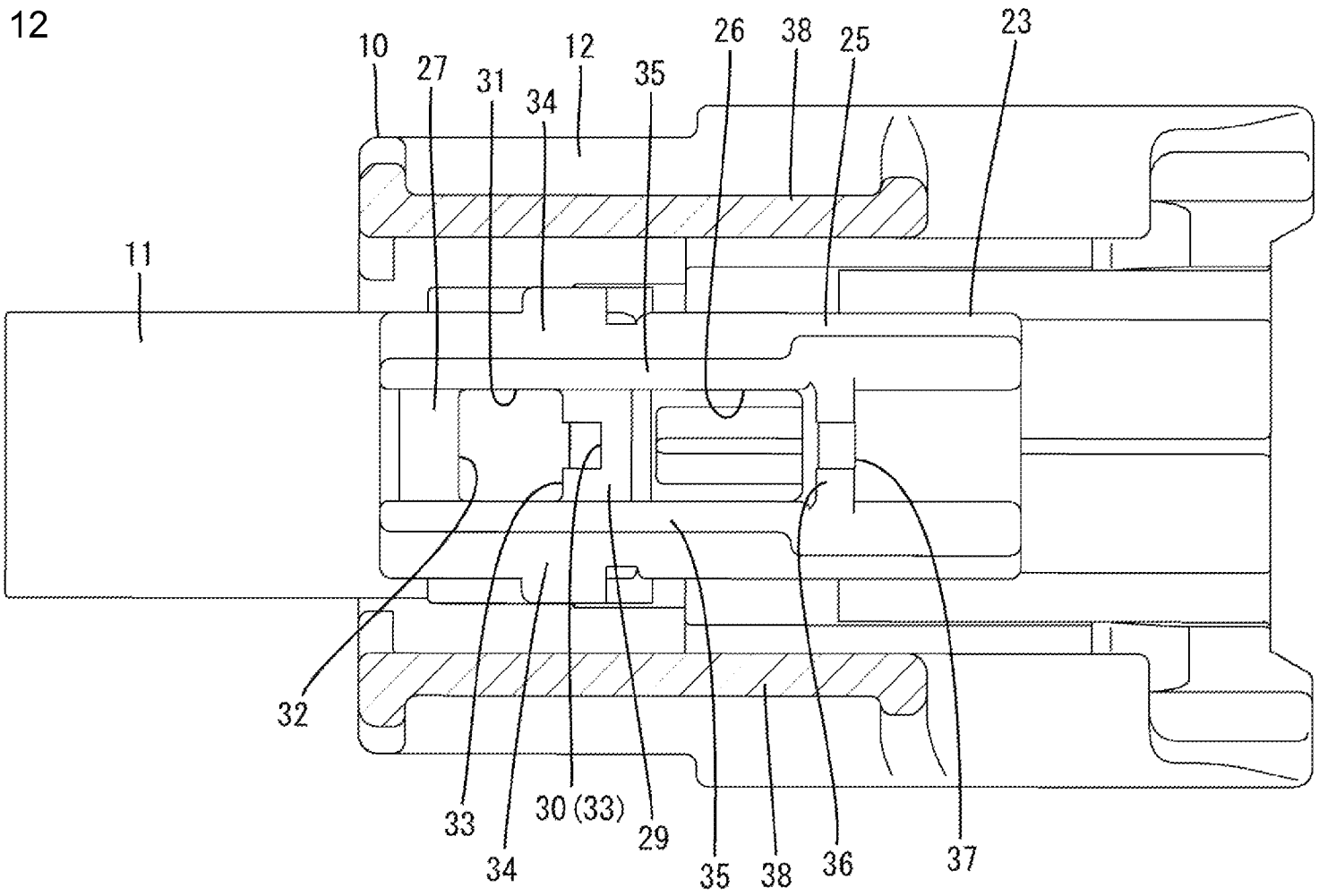
FIG. 12 is a section along B-B of FIG. 11.

As shown in FIG. 12, a front stop 32 is provided on a front side out of the lock hole 31 of the lock arm main body 25, and a rear stop 33 is provided on the rear side. As shown in FIG. 10, the front stop 32 is the front surface of the lock hole 31 and the rear surface of the front end part 27 of the lock arm main body 25, thereby closing the front end of the first groove 26. As shown in FIG. 5, the rear stop 33 is the rear surface of the lock hole 31 and the front surface of the lower wall 29 of the lock arm main body 25, thereby closing the rear end of the second groove 28. Thus, as shown in FIG. 10, the front stop 32 and the rear stop 33 are separated at upper and lower parts of the lock arm main body 25 and are at positions displaced vertically from each other.

The front and rear stops 32 and 33 (excluding the back surface of the recess 30) are arranged vertically. A locking portion 72 of a locking arm 62 contacts the front stop 32 to regulate a forward movement of the detector 60 (see FIG. 10) and contacts the rear stop 33 to regulate a backward movement of the detector 60 (see FIG. 5) when the detector 60 is at the standby position. The front stop 32 is formed by rearwardly removing an unillustrated mold for molding the first groove 26, and the rear stop 33 is formed by forwardly removing an unillustrated mold for molding the second groove portion 28.

Figure 1:
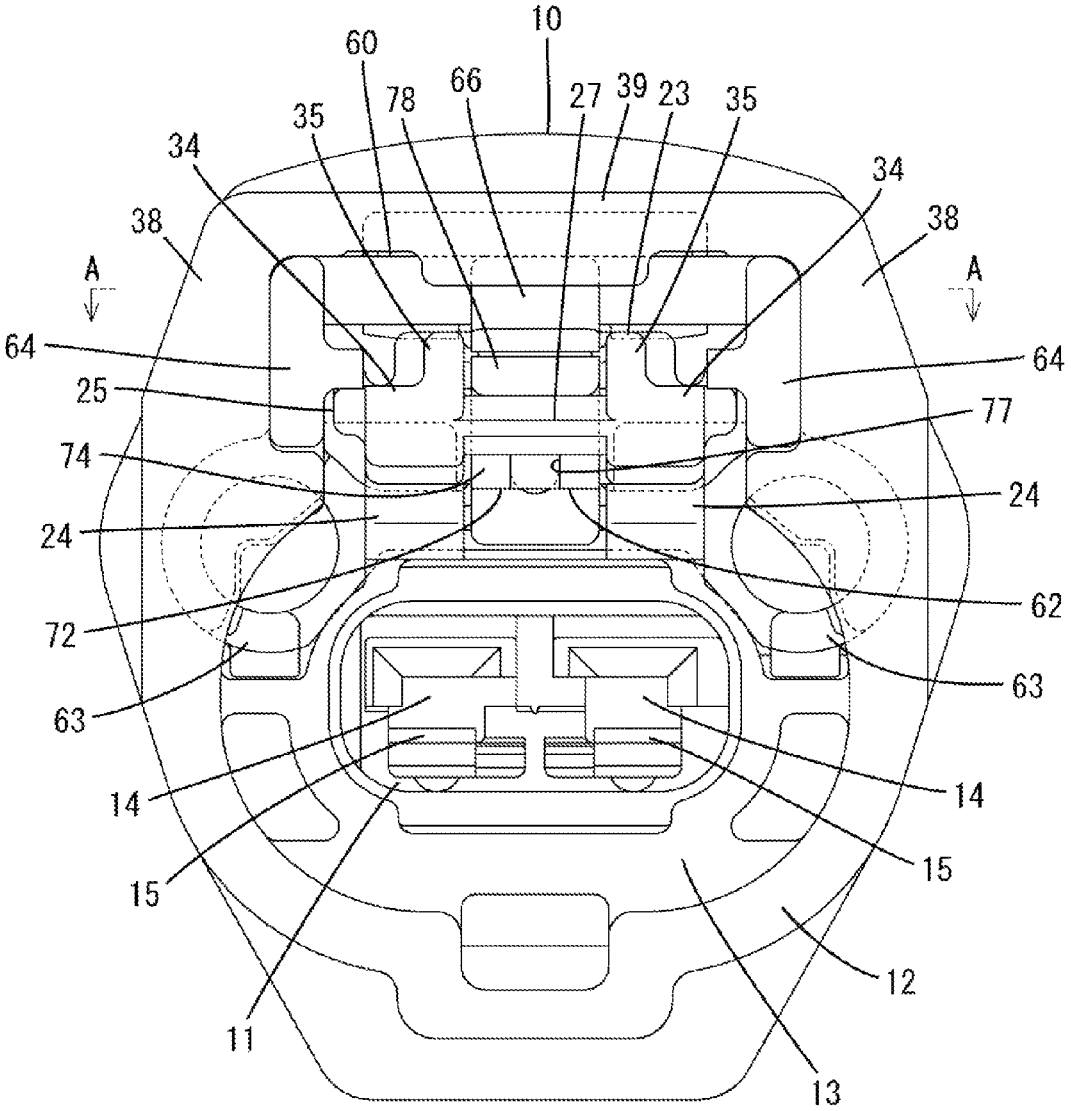
FIG. 1 is a front view of a housing with a detector assembled at a standby position in a connector according to an embodiment of the invention.
Figure 2:
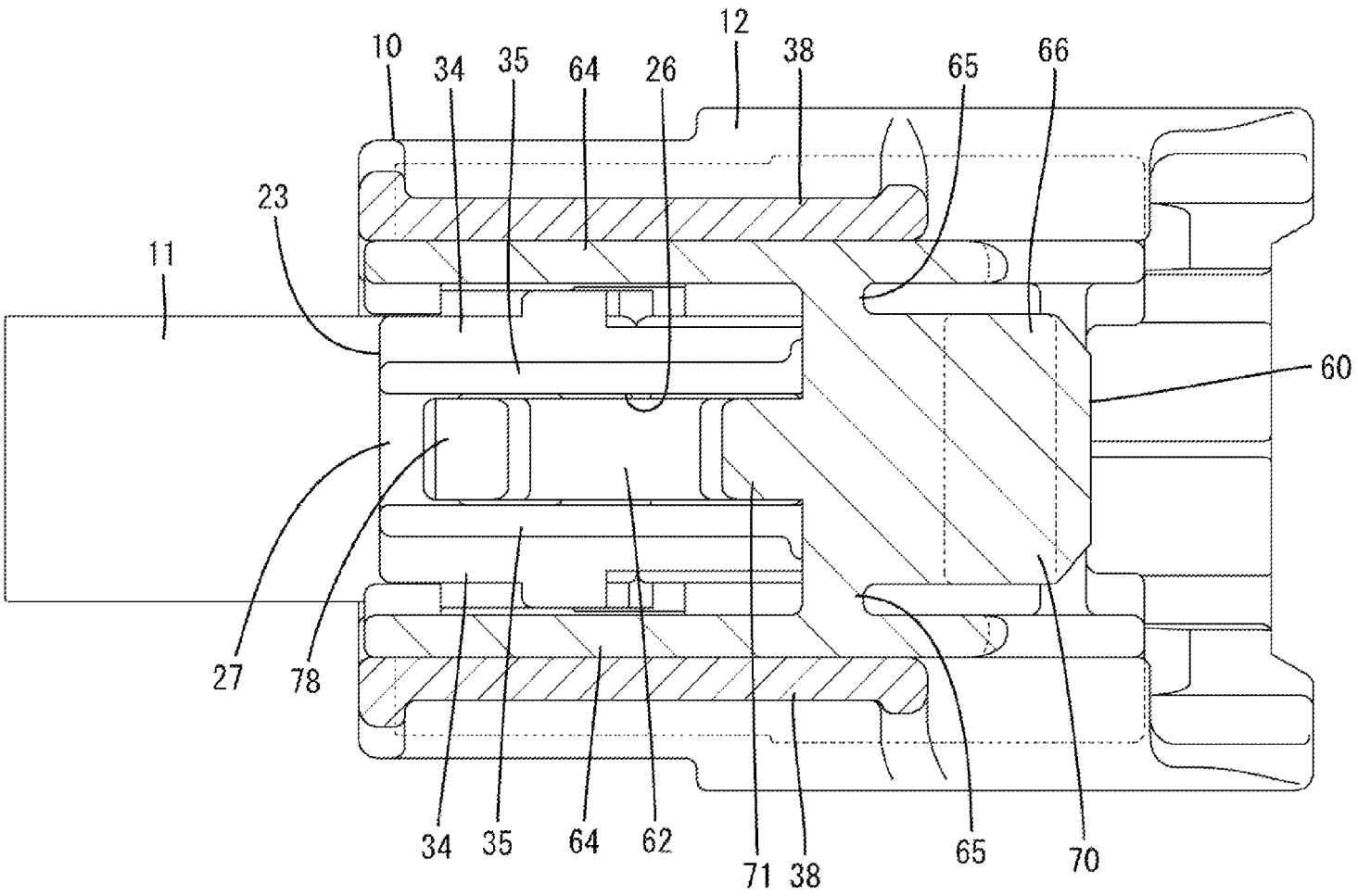
FIG. 2 is a section along A-A of FIG. 1.

As shown in FIGS. 1 and 2, two side walls 34 are provided on opposite left and right sides of the lock arm main body 25 to partition opposite side surfaces of the first and second grooves 26, 28. Two guide walls 35 are formed on upper parts of the inner surfaces of the side walls 34 facing the first groove 26 and extend in the front-back direction. As shown in FIG. 7, each guide wall 35 is a rectangular plate in a side view and extends in the front-back direction from the front end of the lock arm main body 25 to the movement regulating portion 36 and has a substantially constant height over the entire length. The locking arm 62 of the detector 60 is between the guide walls 35 when the detector 60 is assembled with the housing 10 (see FIGS. 1 and 2) and the deflection of the locking arm 62 is guided by the guide walls 35. Note that the front part 27 of the lock arm main body 25 is a laterally extending block that bridges between front parts of the side walls 34 (see FIG. 12). Further, the lower wall 29 of the lock arm main body 25 is a laterally extending plate that bridges between parts of both side walls 34 near the front ends (see FIG. 12).

As shown in FIG. 7, the movement regulating portion 36 is provided on the rear end part of the lock arm main body 25. The movement regulating portion 36 is a laterally extending plate defining the upper surface of the rear end part of the first groove 26 and bridges between the guide walls 35. A receiving groove 28 is recessed on the upper surface of the movement regulating portion 36. The receiving groove 37 extends in the front-back direction and is open on the rear end of the movement regulating portion 36. The front surface of the receiving groove 37 is inclined somewhat backwardly toward the upper end. An operating arm 66 of the detector 60 is insertable into the receiving groove 37 of the movement regulating portion 36.

Figure 4:
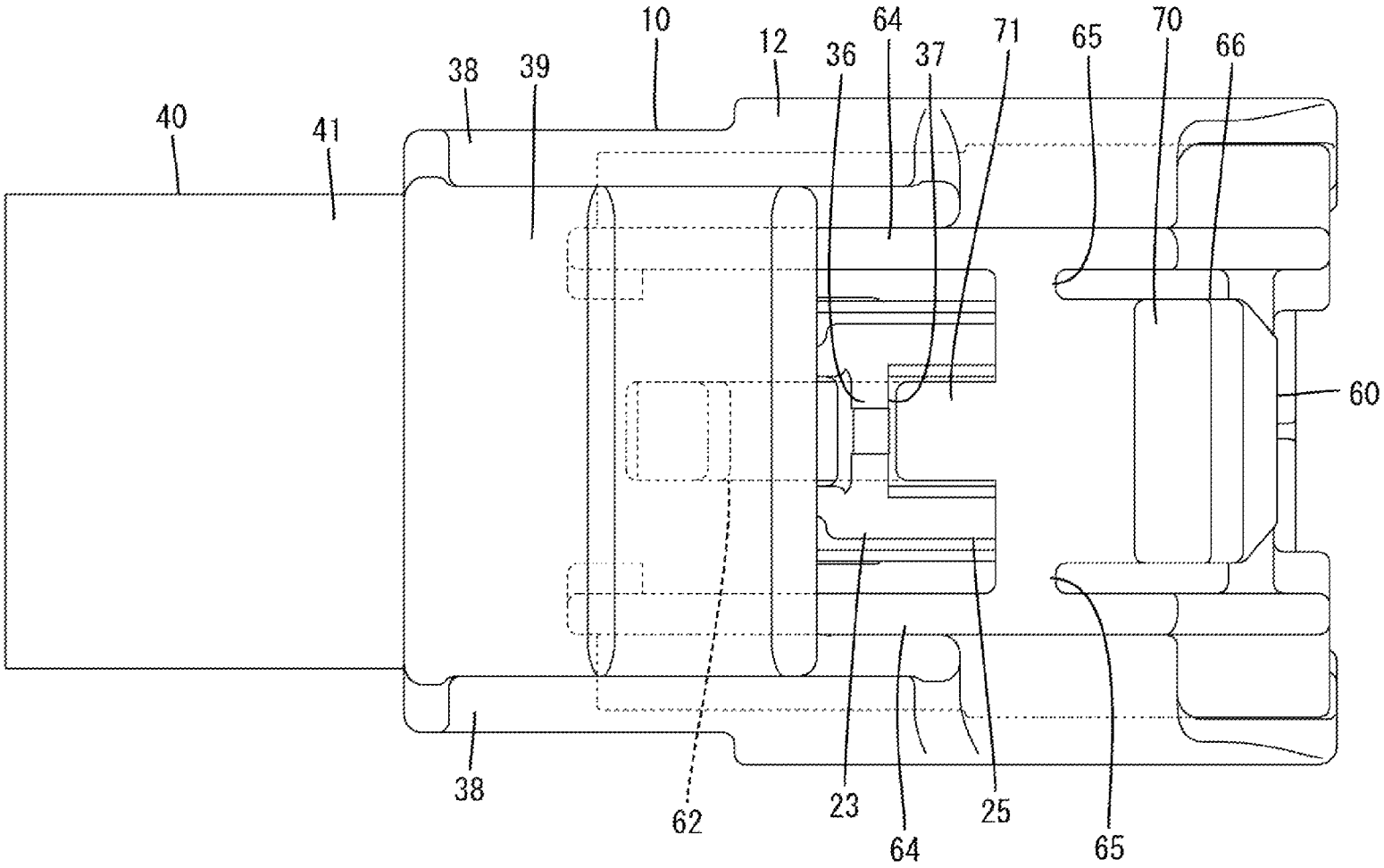
FIG. 4 is a plan view showing the mating housing properly connected to the housing.

As shown in FIGS. 4 and 11, two outer side walls 38 stand at opposite left and right sides of the lock arm 23 on the top of the fitting tube 12, and a planar ceiling wall 39 bridges between the upper ends of front parts of the outer side walls 38. A front end of the lock arm 23 is in a space enclosed by the outer side walls 38 and the ceiling wall 39 for protection from external matter.

Figure 6:
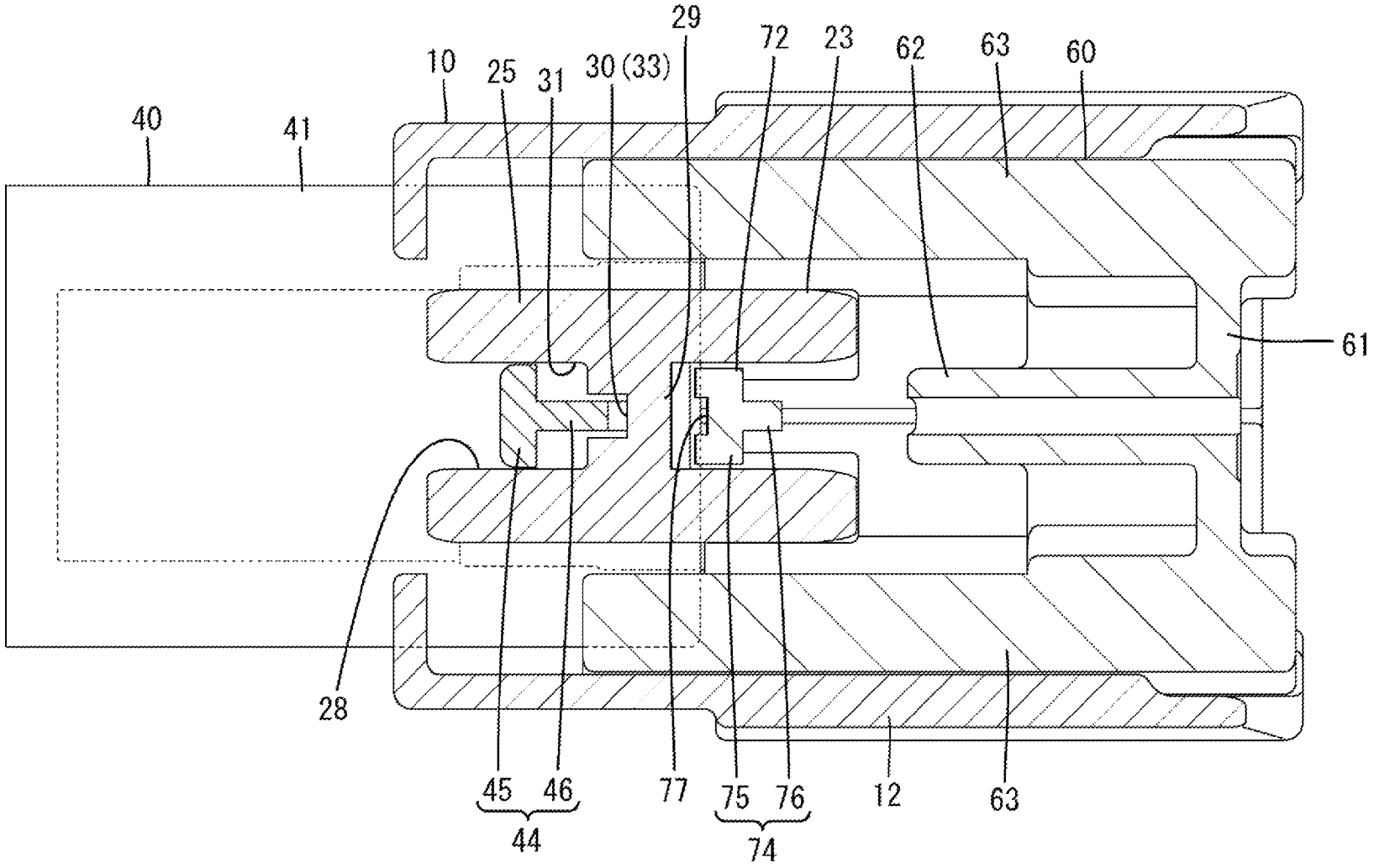
FIG. 6 is a section corresponding to FIG. 4.
Figure 13:
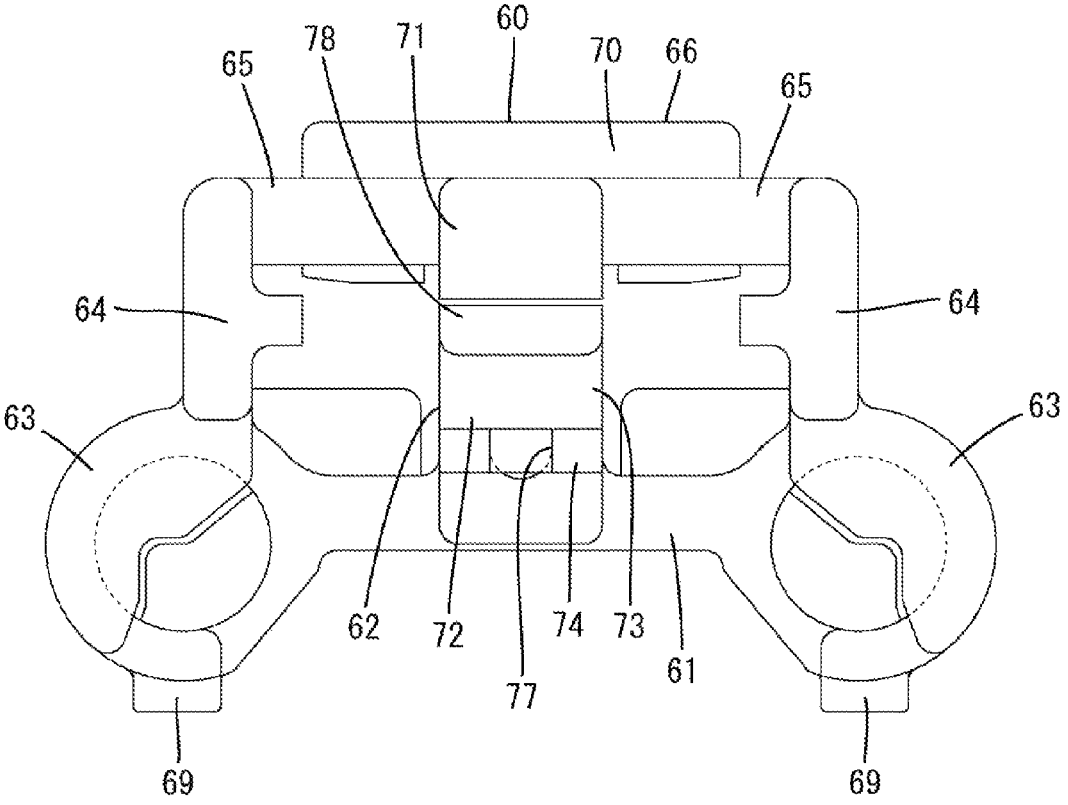
FIG. 13 is a front view of the detector.
Figure 14:
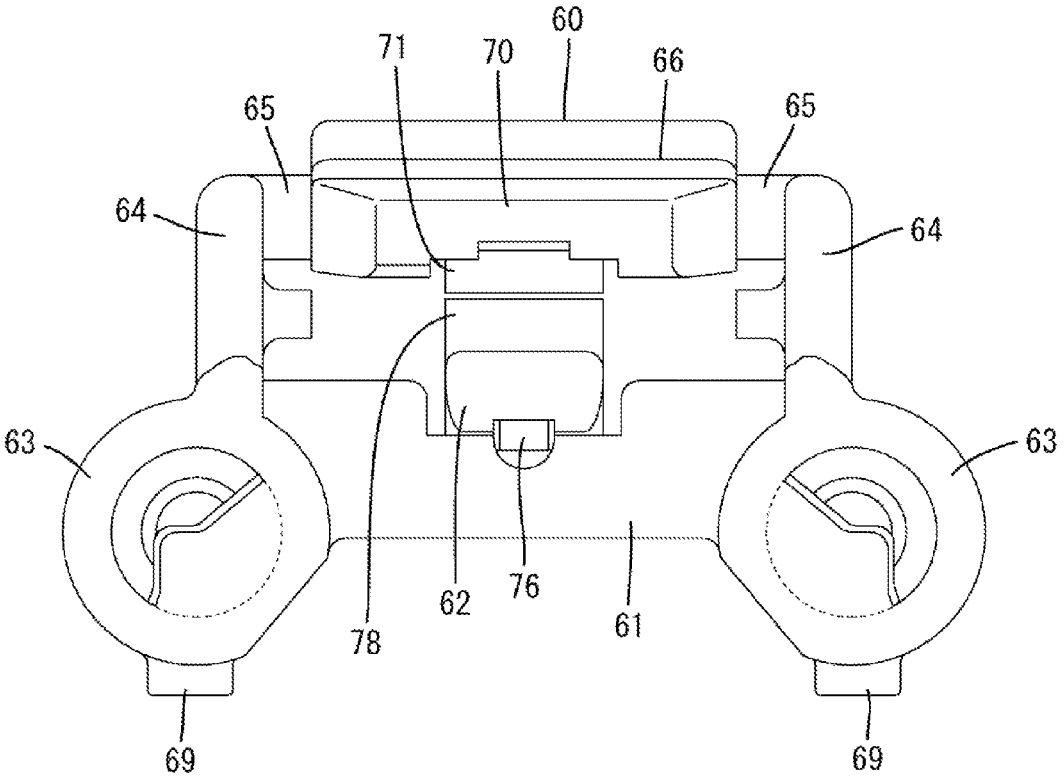
FIG. 14 is a rear view of the detector.
Figure 15:
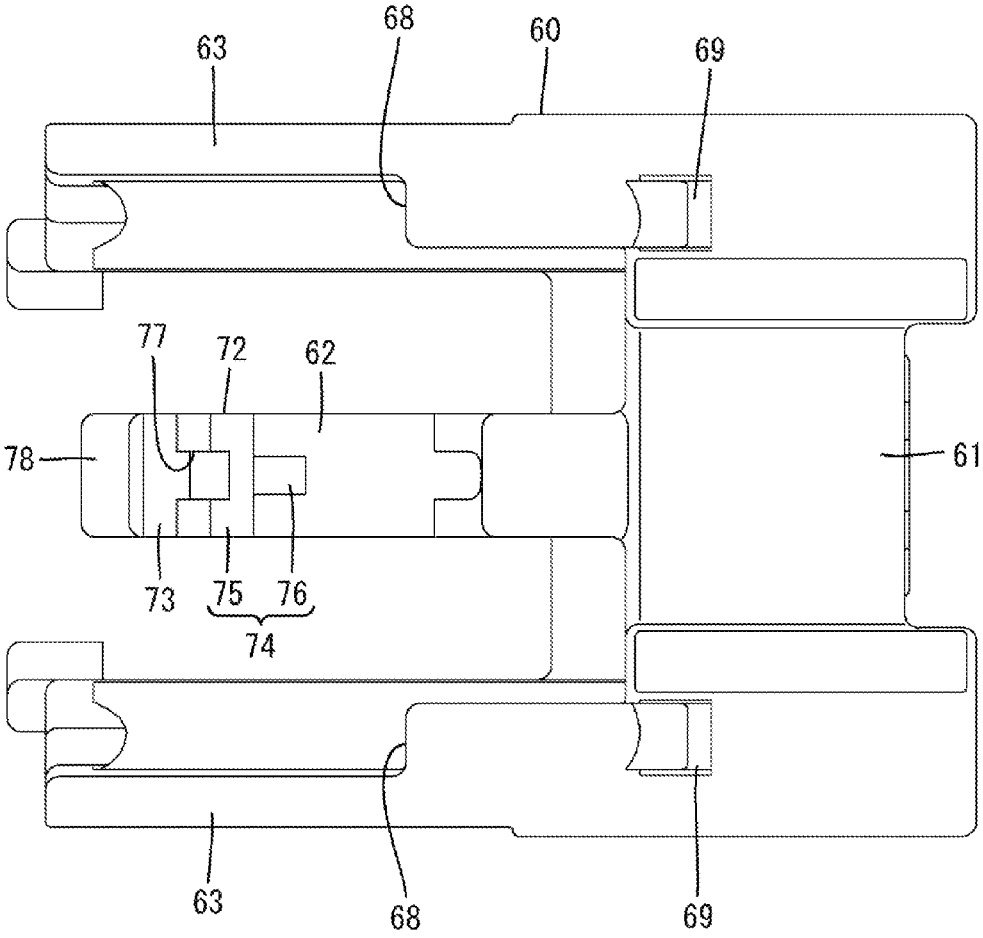
FIG. 15 is a bottom view of the detector.

The detector 60 is made of synthetic resin and is arranged in a space enclosed by the housing main body 11, the outer side walls 38 and the ceiling wall 39, as shown in FIGS. 1 and 7. The detector 60 can slide on the upper surface of the lock arm main body 25 and the surface of the first groove 26 between a standby position (see FIGS. 1 to 3, 5, 7, 8 and 10) and a detection position (see FIGS. 4, 6 and 9) behind the standby position. As shown in FIGS. 13 to 15, the detector 60 is has a base 61 extending laterally and along the front-back direction, and the locking arm 62 extends forward from a lateral central part of the base 61. Two extending tubes 63 extend forward from opposite lateral ends of the base 61, and two standing walls 64 stand up from upper ends of the extending tubes 63 and extend in the front-back direction. Supports 65 couple the operating arm 66 to central parts of the upper ends of the standing walls 64 in the front-back direction.

Unillustrated biasing members are accommodated along the front-back direction in the extending tubes 63. The biasing members may be springs, such as compression coil springs, expandable and compressible in the front-back direction, and front and rear ends thereof are supported on front and rear ends of the extending tubes 63. As shown in FIG. 15, assembling openings 68 are open on the lower surfaces of the extending tubes 63 for inserting the biasing members inside. Further, retaining projections 69 are provided behind the assembling openings 68 on the lower surfaces of the extending tubes 63. The retaining projections 69 are locked to unillustrated projection receiving portions of the housing 10 when the detector 60 is at the detection position, thereby regulating a backward detachment of the detector 60 from the housing 10.

As shown in FIG. 4, the operating arm 66 has a substantially planar pressing portion 70 that is substantially rectangular in a plan view and an engaging projection 71 projects forward from a lateral central part of the front end of the pressing portion 70. The supports 65 are coupled to left and right sides of a front end of the pressing portion 70 and the operating arm 66 is pivotally displaceable in a seesaw manner about the supports 65.

The engaging projection 71 projects forward from the front end of the pressing portion 70 and then curves down, as shown in FIG. 7. The front edge of the engaging projection 71 is inserted into the receiving groove 37 of the movement regulating portion and contacts the front surface of the receiving groove 37 when the detector 60 is at the detection position, thereby regulating a movement of the detector 60 to the standby position. Note that the engaging projection 71 is not shown in FIGS. 8 and 9.

The operating arm 66 pivots in a seesaw manner when the pressing portion 70 is pressed down, and the engaging projection 71 separates from the receiving groove 37 to enable the detector 60 to move to the standby position. Thus, an accidental movement of the detector 60 from the detection position to the standby position is prevented. On the other hand, the mating lock 44 is fit into the lock hole 31 of the lock arm main body when the detector 60 is at the detection position and the two housings 10, 40 are connected properly. The rear part of the lock arm main body 25 is pressed down when the pressing portion 70 is pressed down, and the front part 27 of the lock arm main body 25 is lifted up so that locking between the front part 27 of the lock arm main body 25 and the mating lock 44 is released to make the two housings 10, 40 separable.

As shown in FIGS. 7 and 13, the locking arm 62 is a long narrow substantially rectangular column cantilevered forward from the front end of the base 61 and is deflectable and deformable in the vertical direction with the front end of the base 61 as a support. As shown in FIGS. 13 and 15, the locking portion 72 is provided on a front end of the locking arm 62. The locking portion 72 is composed of a tip locking portion 73 integrally continuous with an intermediate part of the locking arm 62 and a locking protrusion 74 projecting down from the tip locking portion 73. As shown in FIG. 10, the front surface of the tip locking portion 73 is vertical direction and can contact the front stop 32 of the lock arm main body 25 when the detector 60 is at the standby position.

The locking protrusion 74 is rearward of the front surface of the tip locking portion 73. As shown in FIG. 10, the locking protrusion 74 is composed of a locking main body 75 that is substantially trapezoidal in a side view and a projection 76 in the form of a rib projecting back from a lateral central part of the rear surface of the locking main body 75. As shown in FIGS. 5 and 10, when the detector 60 is at the standby position, the locking protrusion 74 is arranged to contact the rear stop 33 of the lock arm main body 25 from behind, thereby regulating a backward movement of the detector 60 to the detection position. The rear surface (except the rear surface of the projecting portion 76) of the locking main body 75 is vertical and can contact the rear stop 33 of the lock arm main body 25 at the standby position.

As shown in FIG. 10, the front surface of the locking main body 75 is a slant inclined back toward the lower end and is arranged to face the second groove 28 and to be exposed forward at the standby position. As shown in FIGS. 5 and 10, the locking main body 75 is cut to provide an escaping groove 77 extending back from the front surface. The escaping groove 77 is a slit extending vertically and is open on the lower surface of the locking main body 75. In the process of connecting the two housings 10, 40, the projecting piece 46 of the mating lock 44 can be inserted into escaping groove 77 to escape.

As shown in FIG. 10, the projection 76 is a rib extending in the front-back direction and has a rear surface inclined somewhat back toward the lower end. When the detector 60 is at the standby position, the projection 76 is inserted in the recess 30 and is arranged that the rear surface of the projection 76 can contact with the back surface of the recess 30.

The detector 60 has a contact portion 78 that stands up from the tip locking portion 73 of the locking arm 62 and then projects forward, as shown in FIGS. 10 and 13. The contact portion 78 is a plate continuous with the upper surface of the locking arm 62 via a step and extends in the front-back direction. The lower surface of the contact portion 78 is arranged along the front-back direction substantially at the same height as the upper surface of the locking arm 62 and can face and contact the upper surface of the front part 27 of the lock arm main body 25 when the detector 60 is at the standby position. The lower surface of the contact portion 78 is at a right angle to the front surface of the tip locking portion 73, as shown in FIG. 10, to forms a substantially L-shaped angular recess 79. When the detector 60 is at the standby position, an upper corner of the front end 27 of the lock arm main body 25 is fit into the angular recess 79. The upper surface of the contact portion 78 is arranged along the front-back direction and the rear surface thereof inclines forward from the upper surface of the locking arm 62 to the upper surface of the contact portion 78. An area of the detector 60 behind the rear surface of the contact portion 78 is open as an escaping space 80.

Prior to the connection of the two housings 10, 40, the detector 60 is inserted into the housing 10 from behind and is assembled at the standby position. In the process of moving the detector 60 to the standby position, the locking arm 62 is inserted into the first groove 26 between the guide walls 35 of the lock arm main body 25 and the locking protrusion 74 contacts the lower wall 29 so that the locking arm 62 is deflected and deformed up. The locking arm 62 resiliently returns when the detector 60 reaches the standby position and, as shown in FIG. 10. Additionally, the locking portion 72 is fit into the lock hole 31, the front surface of the tip locking portion 73 contacts the front stop 32 of the lock arm main body 25 from behind, the lower surface of the contact portion 78 contacts the front part 27 of the lock arm main body 25 from above and the upper corner of the front end 27 of the lock arm main body 25 is fit into the angular recess 79. Further, at the standby position, the rear surface (including the rear surface of the projection 76) of the locking protrusion 74 contacts the rear stop 33 (including the back surface of the recess 30) of the lock arm main body 25 from the front. In this way, the detector 60 is held at the standby position with both forward and backward movements regulated.

With the detector 60 held at the standby position with respect to the housing 10, the movement regulating portion 36 of the lock arm 23 is in the escaping space 80 of the detector 60 and the movement regulating portion 36 and the contact portion 78 overlap each other in the vertical direction (see FIG. 7). Further, at the standby position, the guide walls 35 are opposite to each other to cover the opposite side surfaces of the locking arm 62, as shown in FIG. 2. At this time, the locking arm 62 is entirely covered by the guide walls 35 and is hidden behind the guide wall 35 so as not to be visible in a side view (see FIG. 7). Further, the guide walls 35 are arranged laterally to and in proximity to the locking arm 62 to be deflected and deformed. Thus, the deflection of the locking arm 62 is guided and the locking arm 62 is prevented from swinging laterally. Further, at the standby position, the biasing members are pressed from the front by the mating housing 40 and resiliently compressed. Thus, biasing forces are accumulated and the rear surface of the locking protrusion 74 is pressed tightly against the rear stop portion 33 of the lock arm main body 25.

Figure 8:
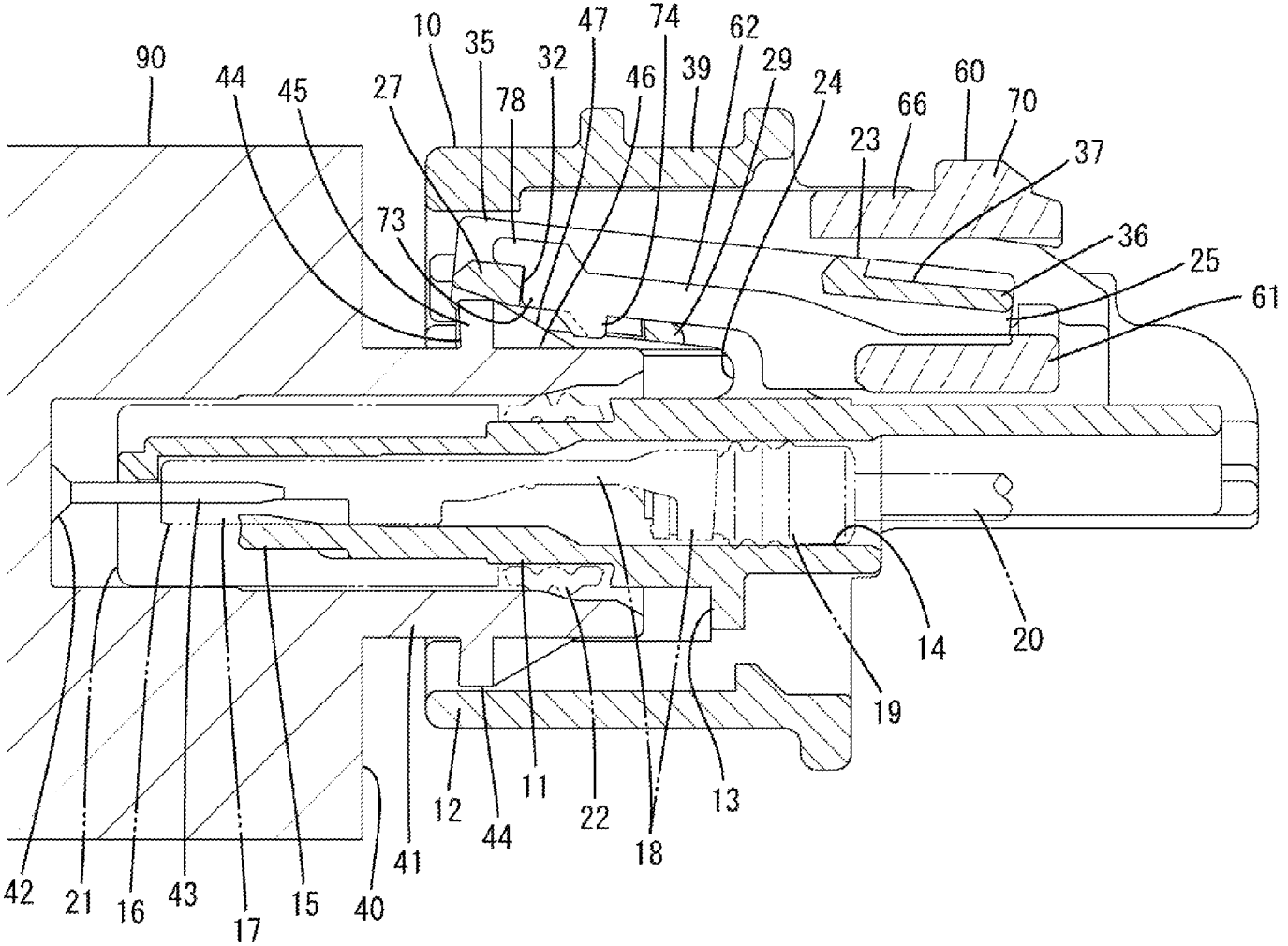
FIG. 8 is a side view in section showing a state where the connection further proceeds from the state of FIG. 7 and a lock arm is deflected and deformed.

Subsequently, as shown in FIG. 7, the housing main body 11 of the housing 10 is fit into the receptacle 41 of the mating housing 40. In the process of connecting the two housings 10, 40, the inclined edge 47 of the projecting piece 46 of the mating lock 44 slides on the front end part 27 of the lock arm main body 25 and, associated with that, the lock arm main body 25 is deflected and deformed up and the front end part 27 moves onto the inclined edge 47 as shown in FIG. 8. At this time, the contact portion 78 contact the front part 27 of the lock arm main body 25 from above and the upper corner of the front end part 27 of the lock arm main body 25 is fit into the angular recess 79 to substantially integrate the locking arm 62 with the lock arm main body 25. Thus, the locking arm 62 also is deflected and deformed up with the lock arm 23. Further, in the process of connecting the two housings 10, 40, the projecting piece 46 of the mating lock 44 can be inserted into the escaping groove 77 of the locking protrusion 74 from the front, thereby avoiding the interference of the mating lock 44 with the locking protrusion 74. Thus, in the process of connecting the two housings 10, 40, the locking protrusion 74 is prevented from coming out of the lock hole 31 and a state where the detector 60 is held at the standby position is ensured.

When the two housings 10, 40 are connected properly, the lock arm 23 resiliently returns and the mating lock main body 45 of the mating lock portion 44 is fit into the lock hole 31 from below. Simultaneously, the locking portion 72 is pushed out by the mating lock 44 and the locking arm 62 is deflected and deformed to separate the locking protrusion 74 from the rear stop 33, thereby releasing the locking between the locking arm 62 and the lock arm 23. The biasing forces of the biasing members are released simultaneously with the separation of the locking protrusion 74 from the rear stop 33 and the detector 60 moves back to automatically reach the detection position (see FIG. 9). Further, the mating lock main body 45 of the mating lock 44 is arranged to contact the front stop 32 of the lock arm main body 25 so that the two housings 10, 40 are held in the state where the separation of the two housings 10, 40 is restricted.

The projecting piece 46 of the mating lock 44 escapes into the recess 30 of the lower wall 29 to escape when the detector 60 reaches the detection position. Additionally, the locking arm 62 is inserted into a space behind the lower wall 29 (see FIG. 6), the front end edge of the engaging projection 71 of the operating arm 66 is fit resiliently into the receiving groove 37 of the movement regulating portion 36 (see FIG. 4) and the retaining projection 69 is locked to the unillustrated projection receiving portion of the housing 10. In this way, the detector 60 is held at the detection position in a state where both forward and backward movements are restricted. Further, at the detection position, the locking arm 62 is maintained in a state entirely covered by both guide walls 35 and is hidden behind the guide wall 35 in a side view (see FIG. 9).

On the other hand, if the housings 10, 40 are not connected properly, the mating lock 44 does not reach a position to fit into the lock hole 31 and the state where the locking protrusion 74 of the locking arm 62 is in contact with the rear stop 33 of the lock arm main body 25 is maintained. Thus, the detector 60 is kept at the standby position. Therefore, it can be judged that the two housings 10, 40 are not connected properly if the detector 60 is at the standby position and that the two housings 10, 40 are connected properly if the detector 60 is at the detection position.

As described above, the locking portion 72 is inserted into the lock hole 31, the front surface of the tip locking portion 73 contacts the front stop 32 of the lock arm main body 25 to regulate a forward movement of the detector 60 and the rear surface of the locking protrusion 74 contacts the rear stop 33 of the lock arm main body 25 to restrict a backward movement of the detector 60 when the detector 60 is at the standby position. In this case, since the front stop 32 and the rear stop 33 are arranged at the opposite front and rear sides of the lock hole 31, forward and backward movements of the detector 60 at the standby position can be regulated by a simple structure by sharing the lock hole 31. Particularly, the rear surface of the locking protrusion 74 rests in contact with the rear stop 33 of the lock arm main body 25 against the biasing forces of the biasing members for stably maintaining a state where the locking portion 72 is locked to the lock arm main body 25.

In addition, the front stop 32 and the rear stop 33 are displaced from each other in the vertical direction, with the front stop 32 being molded together with the first groove 26 by the mold removed backward and the rear stop 33 is molded together with the second groove 28 by the mold removed forward. Thus, adjustments such as the one of making the height range of the front stop portion 32 (engagement margin with the front surface of the tip locking portion 73) larger than that of the rear stop portion 33 (engagement margin with the rear surface of the locking protrusion 74) are possible as described above and a degree of freedom in design is high.

Further, the contact portion 78 contacts the front part 27 of the lock arm main body 25 from above when the detector 60 is at the standby position. Thus, the contact portion 78 can also move up as the front end part 27 of the lock arm main body 25 interferes with the mating lock portion 44 and moves up and the deflection of the locking arm 62 and the lock arm 23 can be synchronized. Accordingly, the integrity of the lock arm 23 and the detector 60 is ensured. Further, since the contact portion 78 project forward after standing up from the tip locking portion 73 of the locking arm 62, the movement regulating portion 36 can be inserted into the area of the detector 60 behind the contact portion 78 (escaping space 80) as described above. As a result, a degree of freedom in designing the lock arm 23 can be enhanced. In addition, since the movement regulating portion 36 and the contact portion 78 are arranged at the positions overlapping each other in the vertical direction, a height increase of the connector as a whole is avoided.

Further, since the interference of the mating lock portion 44 and the locking protrusion 74 can be avoided by the insertion of the projecting piece portion 46 into the escaping groove 77 of the locking protrusion 74 in the process of connecting the two housings 10, 40, the locking portion 72 can be prevented from inadvertently coming out of the lock hole 31 and locking between the locking arm 62 and the lock arm 23 can be maintained satisfactorily. As a result, detection reliability by the detector 60 can be improved. Particularly, since the front surface of the locking protrusion 74 is arranged in an exposed state at the position facing the mating lock 44 in the case of this embodiment, there is a high possibility that the front surface of the locking protrusion 74 butts against the inclined edge 47 of the mating lock 44 in the process of connecting the two housings 10, 40. Thus, it is significantly beneficial to make the interference between the mating lock 44 and the locking portion 72 avoidable by providing the escaping groove 77 on the locking protrusion 74.

Further, since both guide walls 35 of the lock arm 23 are arranged to cover the opposite side surfaces of the locking arm 62 and can guide the deflection of the locking arm 62 regardless of whether the detector 60 is at the standby position or at the detection position, the locking arm 62 is prevented from swinging laterally (in the width direction) when being deflected. As a result, the locking arm 62 is deflected smoothly and the reliability of connection detection by the detector 60 can be improved. In addition, since the locking arm 62 is made laterally unseeable by the guide walls 35, it is held in a state protected from external matter by the guide walls 35.

Other embodiments are briefly described below.

The detector may move forward from the standby position with respect to the housing to reach the detection position.

The biasing members may not be accommodated in the detector and the detector may be manually moved between the standby position and the detection position.

A structure other than the movement regulating portion may be provided at a position of the lock arm overlapping the contact portion in the vertical direction.

One or both of the front stop and the rear stop may be arranged to be inclined with respect to the vertical direction.

The escaping groove may penetrate through the locking protrusion in the front-back direction.

The invention is applicable also to a non-waterproof type connector in which a seal ring is not mounted on a housing and a rubber plug is not connected to a terminal fitting.

LIST OF REFERENCE SIGNS

10 . . . housing
11 . . . housing main body
23 . . . lock arm
25 . . . lock arm main body
26 . . . first groove
27 . . . front end part of lock arm
28 . . . second groove
31 . . . lock hole
32 . . . front stop
33 . . . rear stop
35 . . . guide wall
36 . . . movement regulating portion
40 . . . mating housing
44 . . . mating lock
46 . . . projecting piece portion
47 . . . inclined edge
60 . . . detector

62 . . . locking arm
72 . . . locking portion
77 . . . escaping groove
78 . . . contact portion
80 . . . escaping space

What is claimed is:

1. A connector, comprising:

a mating housing including a mating lock;

a housing connectable to the mating housing and including a lock arm extending in a front-back direction and having a lock hole; and a detector assembled with the housing movably in the front-back direction between a standby position and a detection position and including a locking arm extending in the front-back direction and having a locking portion;

a movement regulating portion provided on a rear part of the lock arm and configured to regulate a movement of the detector to the standby position by interfering with the detector at the detection position, wherein:

the lock arm is deflected and deformed by interference of a front end part of the lock arm with the mating lock and the locking portion is inserted into the lock hole to lock the locking arm to the lock arm, whereby the detector is kept at the standby position in the process of connecting the two housings;

the mating lock is fit into the lock hole to push out the locking portion as the lock arm returns, whereby locking between the locking arm and the lock arm is released to permit a movement of the detector to the detection position and the two housings are held in a state where separation of the two housings is restricted, when the connection of the two housings is completed; and the detector includes a contact portion-q displaceable together with the front end part of the lock arm during the interference of the front end part of the lock arm and the mating lock by contacting the front end part of the lock arm in a height direction intersecting with the front-back direction at the standby position, and the contact portion is formed to project forward after standing up in the height direction from a front end part of the locking arm so that an escaping space is defined above the locking arm and rearward of the contact portion, the movement regulating portion and the contact portion overlapping each other in the height direction so that the movement regulating portion is in the escaping space when the detector is in the detection position.

2. A connector, comprising:

a housing connectable to a mating housing and including a lock arm extending in a front-back direction, the lock arm having a lock hole at a front part of the lock arm and a movement regulating portion provided on a rear part of the lock arm; and a detector assembled with the housing movably in the front-back direction between a standby position and a detection position, the detector including a locking arm extending in the front-back direction, a contact portion projecting up and forward from a front end of the locking arm so that an escaping space being defined above the locking arm and rearward of the contact portion, an engaging projection at a rear part of the detector and projecting down toward the escaping space a movement regulating portion provided on a rear part of the lock arm of the housing and being configured for and being interfering with the engaging projection of the detector for regulating movement of the detector between the detection position and the standby position, the movement regulating portion being in the escaping space and overlapping with the contact portion in a height direction for avoiding enlargement of the connector in the height direction.

3. The connector of claim 2, wherein the lock hole of the lock arm of the housing has opposed front and rear stops, the front end of the locking arm of the detector engaging the front stop of the of the lock arm of the housing when the detector is in the standby position, the locking arm of the detector further having a locking protrusion protruding from a lower surface of the locking arm at a position rearward of the front end of the locking arm, a rear surface of the locking protrusion engaging the rear stop of the lock hole when the detector is in the standby position for regulating forward and rearward movement of the detector relative to the housing when the detector is at the standby position.

4. The connector of claim 2, wherein the movement regulating portion has an upper surface with a receiving groove, the engaging projection of the detector being engaged in the receiving groove when the detector is in the detection position.

5. The connector of claim 4, wherein the receiving groove has a closed front end rearward of a front end of the movement regulating portion, the engaging projection of the detector being opposed to the closed front end of the receiving groove when the detector is in the detection position.

* * * * *